US005356315A

United States Patent [19]

Jankowski et al.

[11] Patent Number: 5,356,315

[45] Date of Patent: Oct. 18, 1994

[54] MODULAR CONNECTOR SYSTEM

[75] Inventors: Meinrad Jankowski, Töping; Wolfgang Jacobi; Paul-Rainer Molitor, both of Mühldorf, all of Fed. Rep. of Germany

[73] Assignee: Otto Dunkel GmbH Fabrik fur elektrotechnische Gerate

[21] Appl. No.: 157,708

[22] Filed: Nov. 24, 1993

[30] Foreign Application Priority Data

Nov. 27, 1992 [DE] Fed. Rep. of Germany ..... 4239988

[51] Int. Cl.[5] ..... H01R 13/502

[52] U.S. Cl. ..... 439/701; 439/680; 439/345

[58] Field of Search ..... 439/677, 680, 695, 701, 439/492, 494, 345, 350, 374, 378, 678, 681

[56] References Cited

U.S. PATENT DOCUMENTS

| | | | |
|---|---|---|---|
| 4,913,667 | 4/1990 | Muz | 439/695 X |
| 4,998,887 | 3/1991 | Kaufman et al. | 439/701 X |
| 5,026,304 | 6/1991 | Furrow | 439/695 |
| 5,236,375 | 8/1993 | Kachlic | 439/701 X |

*Primary Examiner*—Khiem Nguyen
*Attorney, Agent, or Firm*—Friedrich Kueffner

[57] ABSTRACT

A modular connector system includes at least one connector frame composed of a plurality of frame members which can be connected to each other, preferably by means of screws. A plurality of insulating members are secured in the connector frame. Each insulating member has two outer contact surfaces which extend approximately parallel to each other. A plurality of insulating members are arranged next to each other in a row with the outer contact surfaces resting against each other. Each insulating member also has at least two outer holding surfaces which extend transversely of the contact surfaces and are provided with holding projections. The distances between the holding surfaces of all insulating members are equal. The outer holding surfaces are engaged by two of the frame members of the connector frame which extend parallel to each other, such that a movement of the insulating members transversely of the plane of the connector frame is excluded. The connector system further includes a plurality of contact elements for the transmission of energy or signals, wherein the contact elements have the form of pin contacts and/or socket contacts and/or coaxial contacts. The contact elements are secured in receiving bores which extend through the insulating members. At least one of the insulating members in each connector frame is composed of two components.

9 Claims, 2 Drawing Sheets

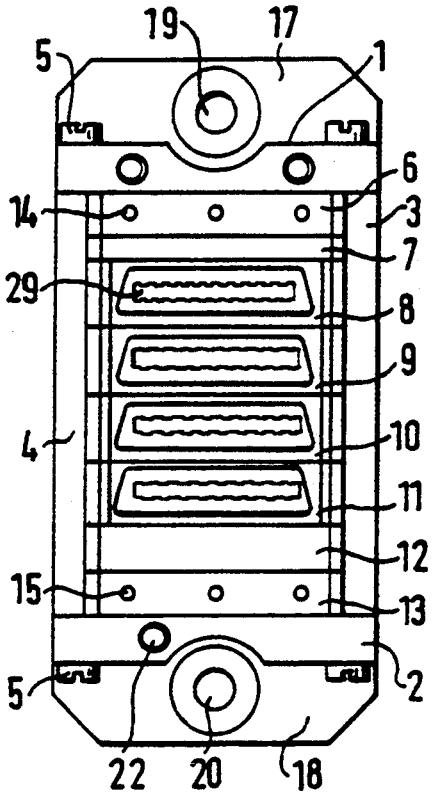
Fig. 1
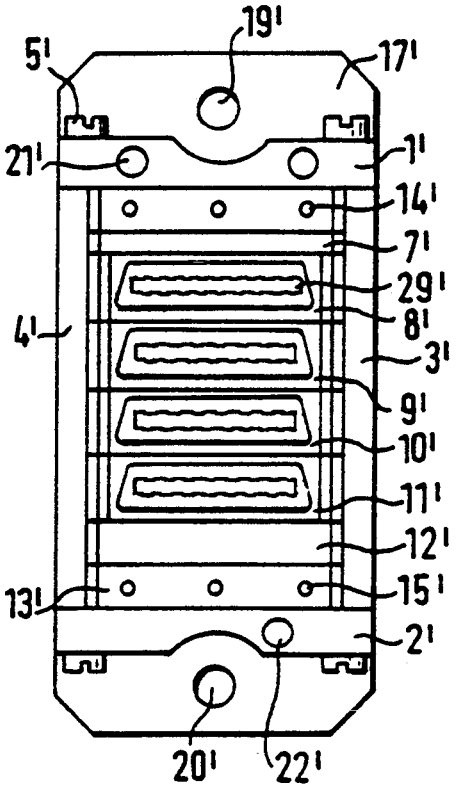
Fig. 3
Fig. 2
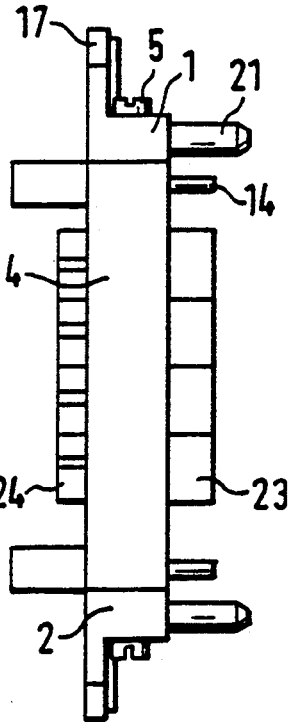
Fig. 4
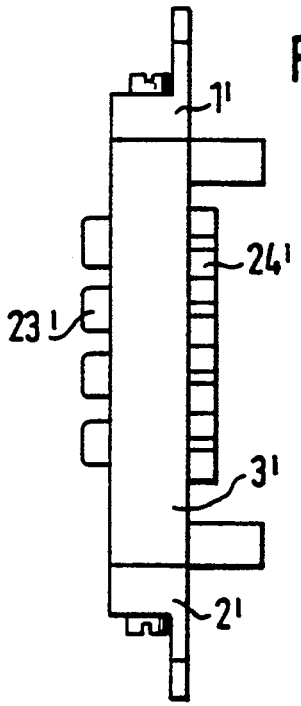

Fig. 5
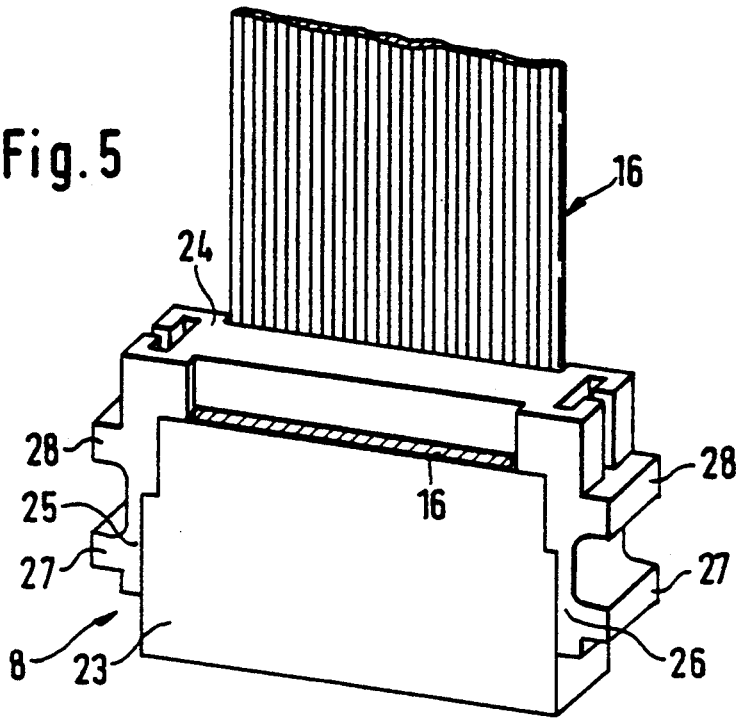
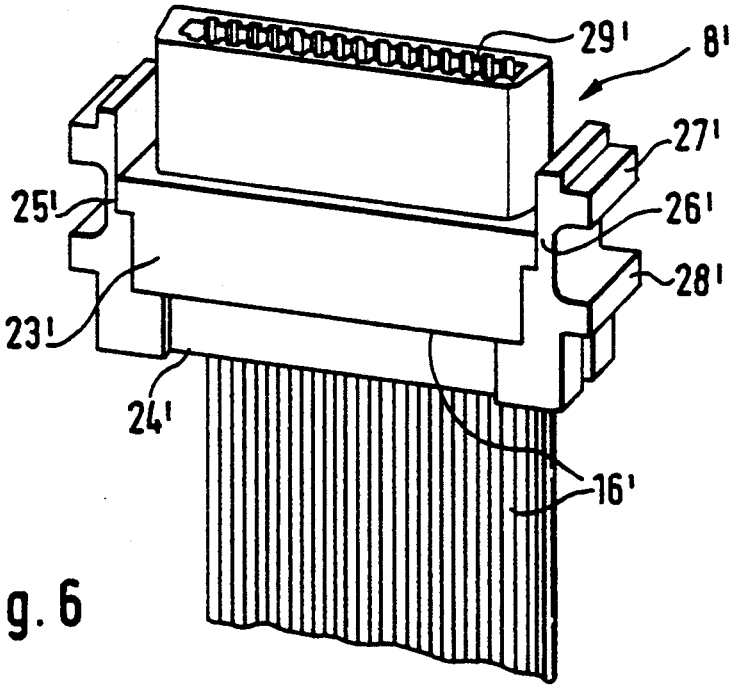
Fig. 6

MODULAR CONNECTOR SYSTEM

BACKGROUND OF THE INVENTION

1. Field of the Invention

The present invention relates to a modular connector system. The modular connector system includes at least one connector frame composed of a plurality of frame members which can be connected to each other, preferably by means of screws. A plurality of insulating members are secured in the connector frame. Each insulating member has two outer contact surfaces which extend approximately parallel to each other. A plurality of insulating members are arranged next to each other in a row with the outer contact surfaces resting against each other. Each insulating member also has at least two outer holding surfaces which extend transversely of the contact surfaces and are provided with holding projections. The distances between the holding surfaces of all insulating members are equal. The outer holding surfaces are engaged by two of the frame members of the connector frame which extend parallel to each other, such that a movement of the insulating members transversely of the plane of the connector frame is excluded. The connector system further includes a plurality of contact elements for the transmission of energy or signals, wherein the contact elements have the form of pin contacts and/or socket contacts and/or coaxial contacts. The contact elements are secured in receiving bores which extend through the insulating members.

2. Description of the Related Art

Known connector systems of the above-described type are produced by Otto Dunkel GmbH Fabrik für elektrotechnische Geräte under the name ODU-MAC. These connector systems facilitate a variable configuration and arrangement of different connector modules in one and the same connector frame in dependence on the type of elements to be connected. In practical use, this unit composed of connector module and connector frame is connectable to a unit of connector module and connector frame which is of complimentary construction. The insulating members which can be secured in the connector frame are suitable for receiving only a few pin contacts or socket contacts for energy transmission or also coaxial contacts having a substantial cross-section. However, additional insulating members are provided for receiving always a more or less large number of pin contacts or socket contacts of smaller cross-section which are usually used for signal transmission.

In addition to these units of connector module and connector frame, flat cable connectors have been used for some time for connecting control circuits which are conducted through multiple-wire flat cables. These flat cable connectors include an insulating member which has a corresponding number of plug-in contacts or socket contacts arranged in one row or even in several rows with a grid spacing corresponding to the distance between the wires of the flat cable. Such connectors are widely used in practice under the name D-Sub-Connector; the dimensions and pole configurations of these connectors are standardized, for example, in German industrial standard DIN 41652 and in MS 18274 and MS 18276. For connection of the plug-in contacts or socket contacts to the flat cable, these contacts are equipped at one end thereof with an insulation displacement contact. The size of the insulating member is adapted to the size of the flat cable connector. If the connector is not sufficient for connecting the existing circuits, a plurality of flat cable connectors, which are independent of each other, are required.

SUMMARY OF THE INVENTION

Surprisingly, it has been found that the advantages of the above-described known connector systems can also be utilized for effecting connections through multiple-wire flat cables.

In accordance with the present invention, this can be achieved essentially by a special configuration of the insulating members which form the connector modules of the connector system. Specifically, in accordance with the present invention, at least one of the insulating members in each connector frame is composed of two components. One of the components of the insulating member includes the contact elements which, on the one hand, lead to plug contacts or socket contacts arranged in a protected manner in this component, and, on the other hand, lead to insulation displacement contacts which project beyond the first component and serve for the connection to a flat cable which is mounted between this first component and a pressed-on second component. The second component has outer webs which engage over and securely grasp the first component, wherein the holding projections of the insulating member are provided on the outer surfaces of the webs.

As soon as insulating members of this type, to whose contacts the flat cables are connected, are placed between the frame members of the connector frame which extend parallel to each other, the webs of the second component of the insulating member which are grasped from the outside and, in turn, engage over the first component and thereby secure the first component, can no longer be moved apart from each other as a result of elastic deformation and cannot release the first component. On the contrary, because of the insertion into the connector frame, a stable connection between the two components of the insulating member is ensured. Moreover, it is insured that the two-component insulating member with the flat cable connected thereto is securely supported in the connector frame. The connector frame can then be connected, for example, to another connector frame which is of analogous, but complimentary construction.

Of course, the connector system according to the present invention can be used with particular advantage when it is the object to conduct a very large number of circuits securely through one connector, even if each insulating member forming the connector module of the connector system only has a number of contacts which corresponds to the number of wires of a flat cable, while several flat cables are to be connected simultaneously. In this case, it is merely necessary to arrange several insulating members of equal construction in one and the same connector frame. As a result of the above-described configuration of the webs in relation to the frame components surrounding the webs from the outside, it is possible that the connector frame is grasped in the manner of a conventional plug connector and the connector frame can be comfortably and securely manipulated when a connection is effected, for example, to a corresponding opposing plug connector.

In accordance with another very useful further development of the invention, a snap-in locking device each is provided between the elastically deformable outer webs of the second component and the outer side of the first component of the insulating member which is surrounded by the outer webs of the second component.

In accordance with a particularly advantageous structural feature, the snap-in locking device is formed by locking projections provided on an inner side of the webs, wherein, in the connected state of the two components of each insulating member, the locking projections engage in corresponding recesses.

In accordance with another advantageous feature, the holding projections on the outer surfaces of the webs are constructed in the form of projecting keys which extend transversely of the plane of the insulating member preferably over the entire width of the insulating member. The frame members of the connector frame have recesses which are dimensioned in accordance with the dimension of the keys and make it possible to engage the keys from the outside.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there is illustrated and described a preferred embodiment of the invention.

BRIEF DESCRIPTION OF THE DRAWING

In the drawing:

FIG. 1 is a schematic front view of a unit composed of connector module and connector frame;

FIG. 2 is a side view of the unit of FIG. 1;

FIG. 3 is a front view of a complimentary unit which can be connected with the unit of FIGS. 1 and 2;

FIG. 4 is a side view of the unit of FIG. 3;

FIG. 5 is a perspective view, on a larger scale, of an insulating member forming a connector module according to the invention insertable in a connector frame, wherein the insulating member is connected to a flat cable; and FIG. 6 is a perspective view, corresponding to the view of FIG. 5, illustrating an analogous insulating member which is insertable in a connector frame and connectable to the insulating member according to FIG. 5.

DETAILED DESCRIPTION OF THE PREFERRED EMBODIMENT

As illustrated in the drawing, each connector frame/connector module unit according to FIGS. 1–4 includes a connector frame composed of two end pieces 1, 2 and two comparatively longer frame members 3, 4 which are connectable to each other by means of four screws 5. The connector frame preferably is of aluminum.

In the illustrated embodiment, eight insulating members 6–13 are mounted within the space defined by the connector frame. The insulating members 6 and 13 are of conventional construction and contain three pin contacts 14 and 15. The insulating members 7 and 12 are spacer members of different thicknesses. The insulating members 8–11 are constructed in accordance with the present invention and are composed of two components. One of these insulating members, i.e., the insulating member 8, is illustrated in FIG. 5 on a larger scale in a perspective view after having been connected to a flat cable 16.

FIG. 1 shows that each end piece 1, 2 of the connector frame has a projecting flange 17 and 18, respectively. The flange 17 is provided with a central bore 19 and the flange 18 is provided with a central bore 20. The end piece 1 is equipped with two guide bolts 21 and the end piece 2 is equipped with only one guide bolt 22.

As can be seen in FIG. 5, the insulating member 8 is composed of components 23 and 24. The component 23 has a plurality of contact elements, not shown, which are mounted in a protected manner in the component 23. The contact elements lead to plug-in contacts 29 which are not illustrated in FIG. 5 and are only schematically illustrated in FIG. 1. The other ends of the contact elements lead to insulation displacement contacts, not shown, for connection to the flat cable 16 shown in FIG. 5. This flat cable 16 is mounted between the first component 23 and the pressed-on second component 24. The second component 24 has two outer webs 25 and 26 by means of which the second component 24 engages over the first component 25 in a securely grasping manner. The outer webs 25 and 26 are slightly elastically deformable. In order to ensure the secure support between the components, a snap-in locking device, which is only partially illustrated, is provided between the webs 25, 26 and the outer side of the first component 23 of the insulating member 8 which is surrounded by the webs 25, 26. The snap-in locking device is formed by locking projections which protrude at the inner sides of the webs and engage in corresponding recesses of the component 23 when the two components 23, 24 are connected to each other.

As further illustrated in FIG. 5, keys 27, 28 are provided on the outer surfaces of the webs. The keys 27, 28 extend transversely of the plane of the insulating member 8 along the entire thickness thereof. The keys 27, 28 form holding projections which, in the assembled state illustrated in FIG. 1, cooperate with the frame members 3 and 4. For this purpose, the frame members 3 and 4 have recesses, not illustrated in detail, which are dimensioned so as to correspond to the dimension of the keys and make it possible that the keys 27, 28 are engaged from the outside. Together with the recesses in the frame members 3, 4, the keys 27, 28 ensure that the insulating member 8 as well as the analogously constructed insulating members 9–11 are securely supported in the connector frame. The same is true for the remaining insulating members 6, 7 and 12, 13 which are also provided with keys, not shown, which form analogous holding projections.

After being assembled in the connector frame, all insulating members 6–13 are arranged next to each other in a row with the parallel outer contact surfaces thereof resting against each other. After the screws 5 have been tightened, the insulating members form together with the frame members 1–4 a stable unit composed of connector frame and insulating members.

The structural components illustrated in FIGS. 3, 4 and 6 correspond to the structural components shown in FIGS. 1, 2 and 5 and are denoted by the same reference numerals, except that the reference numerals of FIGS. 3, 4 and 6 are provided with the affix "'". Accordingly, the description provided above in connection with FIGS. 1 and 5 is analogously applicable to FIGS. 3, 4 and 6, with the following exceptions.

As can be seen in FIG. 6, the component 23' of the insulating member 8' is constructed differently from the component 23 of FIG. 5. Thus, as only schematically illustrated, the contact elements which are mounted in a protected manner in component 23' lead with one end to socket contacts 29' which, in the connected state, interact with the plug-in contacts 29 shown in FIG. 1.

Corresponding to the guide bolts 21 and 22 of the connector frame of FIGS. 1 and 2, the connector frame of FIGS. 3 and 4 has bores 21' and 22' Socket contacts 14' and 15' correspond to the pin contacts 14 and 15 in the insulating members 6 and 13 of FIGS. 1 and 2.

As can be seen in FIG. 2, the guide bolts 21, 22 project beyond the pin contacts 14 and 15 and, therefore, ensure a problem-free alignment of the units composed of connector frame and insulating members shown in FIGS. 1 and 2 relative to the complimentary units shown in FIGS. 3 and 4. Since two guide bolts are provided on one side while only one guide bolt is provided on the other side, it is ensured that the connector units cannot be reversed when they are to be connected.

The invention is not limited by the embodiment described above which is presented as an example only but can be modified in various ways within the scope of protection defined by the appended patent claims.

We claim:

1. A modular connector system comprising at least one connector frame extending in a plane and composed of a plurality of frame members which can be connected to each other, a plurality of insulating members secured in the connector frame, each insulating member having two outer contact surfaces which extend approximately parallel to each other, the plurality of insulating members being arranged next to each other in a row with the outer contact surfaces resting against each other, each insulating member further having at least two outer holding surfaces which extend transversely of the contact surfaces, holding projections being arranged on the holding surfaces, wherein distances between the holding surfaces of all insulating members are equal, the outer holding surfaces being engaged by two of the frame men,hers of the connector frame extending parallel to each other, such that a movement of the insulating members transversely of the plane of the connector frame members of the connector frame extending paralprising a plurality of contact elements for transmitting energy or signals, the contact elements being secured in receiving bores which extend through the insulating members, at least one of the insulating members in each connector frame comprising a first component and a second component pressed onto the first component, wherein the first component includes the contact elements connected to one of plug contacts and socket contacts arranged in a protected manner in the first component and to insulation displacement contacts which project beyond the first component for connection to a flat cable mounted between the first component and the second component, the second component having outer webs engaging over and securely grasping the first component, wherein the holding projections of the insulating member are provided on the outer surfaces of the webs.

2. The modular connector system according to claim 1, comprising screw connections between the frame members.

3. The modular connector system according to claim 1, wherein the contact elements are pin contacts.

4. The modular connector system according to claim 1, wherein the contact elements are socket contacts.

5. The modular connector system according to claim 1, wherein the contact elements are coaxial contacts.

6. The modular connector system according to claim 1, wherein the outer webs of the second component are elastically deformable, a snap-in locking device each being provided between an outer side of the first component of the insulating member surrounded by the outer webs of the second component.

7. The modular connector system according to claim 6, wherein the snap-in locking device comprises locking projections provided on an inner side of the webs and corresponding recesses in the connector frame, wherein, in the connected state of the two components of each insulating member, the locking projections engage in the recesses.

8. The modular connector system according to claim 7, wherein the holding projections on the outer surfaces of the webs are projecting keys extending transversely of the plane of the insulating member, and wherein the frame members of the connector frame define the recesses, the recesses being dimensioned in accordance with the dimension of the keys configured to engage the keys from the outside.

9. The modular connector system according to claim 7, wherein the projecting keys extend over the entire width of the insulating member.

* * * * *